US007886507B2

(12) United States Patent
McGuinness, Jr.

(10) Patent No.: US 7,886,507 B2
(45) Date of Patent: Feb. 15, 2011

(54) CUSTOM PACKAGE WRAP

(75) Inventor: William F. McGuinness, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 109 days.

(21) Appl. No.: 12/405,800

(22) Filed: Mar. 17, 2009

(65) Prior Publication Data

US 2009/0177317 A1 Jul. 9, 2009

Related U.S. Application Data

(62) Division of application No. 11/766,292, filed on Jun. 21, 2007, now Pat. No. 7,530,210.

(51) Int. Cl.
*B65B 3/30* (2006.01)
*B31B 1/88* (2006.01)
*G06F 17/00* (2006.01)

(52) U.S. Cl. ..... 53/504; 53/411; 53/140; 493/320; 700/235

(58) Field of Classification Search ..... 53/411, 53/504, 140, 131.1; 700/233, 235; 493/320
See application file for complete search history.

(56) References Cited

U.S. PATENT DOCUMENTS 5,038,293 A * 8/1991 Goodman ..... 700/233
5,490,597 A 2/1996 Schluger
5,655,356 A * 8/1997 Ginestra et al. ..... 53/504
5,671,593 A 9/1997 Ginestra et al.
5,850,963 A 12/1998 Chang
5,877,787 A 3/1999 Edge
6,032,004 A 2/2000 Mirabella, Jr. et al.
6,330,542 B1 * 12/2001 Sevcik et al. ..... 705/8
6,470,232 B2 * 10/2002 Parry ..... 700/233
6,669,021 B1 * 12/2003 Spielman ..... 206/457
6,886,309 B2 * 5/2005 Phillips ..... 53/411
7,210,407 B2 * 5/2007 Silverbrook et al. ..... 101/483
7,317,965 B2 * 1/2008 Koyama ..... 700/233
2003/0166443 A1 * 9/2003 May ..... 493/320
2003/0187946 A1 10/2003 Cable
2003/0236715 A1 * 12/2003 Leo ..... 705/26
2005/0157141 A1 7/2005 Silverbrook et al.
2006/0219108 A1 10/2006 Dorrell et al.
2006/0227203 A1 10/2006 Patterson
2007/0007324 A1 1/2007 Weddignton et al.
2007/0034545 A1 2/2007 Sabalaskey et al.

FOREIGN PATENT DOCUMENTS

EP 1 091 565 11/2001

* cited by examiner

*Primary Examiner*—Paul R Durand
(74) *Attorney, Agent, or Firm*—Gibb I.P. Law Firm, LLC

(57) ABSTRACT

One method embodiment herein inputs a package size and a package wrap pattern. The method calculates a sheet size corresponding to the package size, and prints the sheet of package wrap. The sheet of package wrap has the package wrap pattern and can have fold markings corresponding to corners of the package. The sheet of package wrap has dimensions equal to the sheet size.

11 Claims, 2 Drawing Sheets

FIG. 2
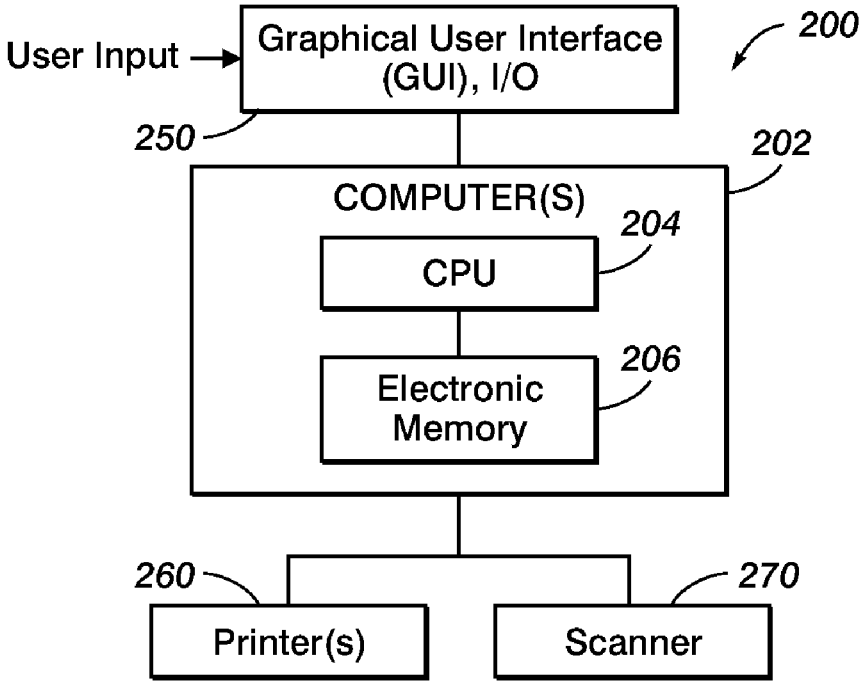
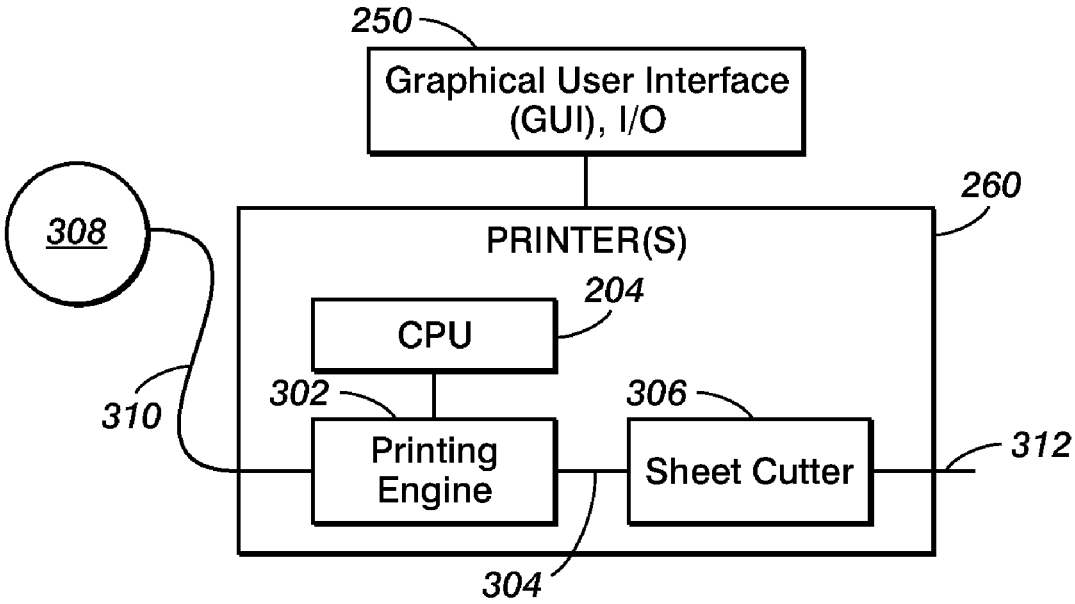
FIG. 3

CUSTOM PACKAGE WRAP

CROSS-REFERENCE TO RELATED APPLICATIONS

This application is a Division of U.S. application Ser. No. 11/766,292 filed Jun. 21, 2007, the complete disclosure of which, in its entirety, is herein incorporated by reference.

BACKGROUND AND SUMMARY

Embodiments herein generally relate to systems, methods, services, etc. for printing package wrap (e.g., gift wrap) and more particularly to a system, service, and method that prints custom sheets of package wrap that matches a selected package size precisely.

Conventional systems exist for printing custom package wrap. For example, U.S. Patent Publications 2007/0007324 and 2007/0034545 (the complete disclosures of which are incorporated herein by reference) disclose manual systems for customizing gift wrap. Similarly, U.S. Patent Publication 2006/0219108 (the complete disclosures of which is incorporated herein by reference) discloses an automated system for adding personal text to gift wrap.

Such conventional systems for printing customized package wrapping (gift wrapping) paper are generally only available through a few limited methods. One of the methods is special catalog ordering, which has a long turnaround time and which delivers rolls of wrapping paper in preset lengths and widths that are not related to the size of the package to be wrapped. Another method allows the user to print individual sheets on their personal printer; however, the size of such sheets is usually limited to a maximum of 11 by 17 inches, which is usually too small to wrap most packages. Sometimes, these smaller individual sheets are stitched or taped together to form larger sheets; however such processes are cumbersome and produce a somewhat unattractive final product. Further, neither of these methods provides any ability to custom fit the wrapping paper to the object that is to be wrapped (e.g., the package).

However, embodiments herein provide methods, a computer program, a service, and a system for package wrap custom printing custom sized sheets of gift wrap. For example, one method embodiment herein inputs a package size and a package wrap pattern. The method calculates a sheet size corresponding to the package size, and prints the sheet of package wrap. The sheet of package wrap has the package wrap pattern and can have fold markings corresponding to corners of the package. The sheet of package wrap has dimensions equal to the sheet size.

The "calculating" performed by embodiments herein comprises converting a three-dimensional measure of the package size into a two-dimensional measure of the sheet size. Further, the "calculating" of the sheet size can comprise determining a first area sufficient to cover all surface area of a package having the package size and adding an overlap area to the first area to produce the sheet size.

When inputting the package size, a user is requested to input such items as the height, width, and depth of a package. Further, when the user is inputting the package wrap pattern, they are provided the options of selecting the package wrap pattern from a database, scanning an item to store the package wrap pattern into memory, providing a file having the package wrap pattern, and/or hand generating the package wrap pattern using a graphic user interface.

A system embodiment herein comprises a graphic user interface adapted to receive input of the package size and the package wrap pattern. A processor is operatively (directly or indirectly) connected to the graphic user interface. The processor is adapted to calculate a sheet size corresponding to the package size and optionally calculate fold markings corresponding to corners of the package size. A printer is also operatively connected to the processor. The printer comprises a printing engine adapted to print the package wrap pattern on the sheet of package wrap and, optionally, the fold markings. A sheet cutter can be included within or separate from the printer. The sheet cutter is adapted to cut the sheet of media into dimensions equal to the sheet size. A continuous media supply (e.g., roll of printing media such as paper) is positioned to supply a continuous, unbroken sheet of media to the printer.

The graphic user interface comprises inputs such as the height, width, and depth of the package to input the package size. Further, the graphic user interface includes inputs for selecting the package wrap pattern from a database, scanning the package wrap pattern into memory, providing a file having the package wrap pattern, and/or generating the package wrap pattern using a graphic user interface.

The processor is adapted to calculate the sheet size by determining a first area sufficient to cover all surface area of a package having the package size and adding an overlap area to the first area to produce the sheet size. These and other features are described in, or are apparent from, the following detailed description.

BRIEF DESCRIPTION OF THE DRAWINGS

Various exemplary embodiments of the systems and methods are described in detail below, with reference to the attached drawing figures, in which:

FIG. 2 is a schematic representation of a system according to embodiment herein; and FIG. 3 is a schematic representation of a printer according to embodiment herein.

DETAILED DESCRIPTION

Figure 1:
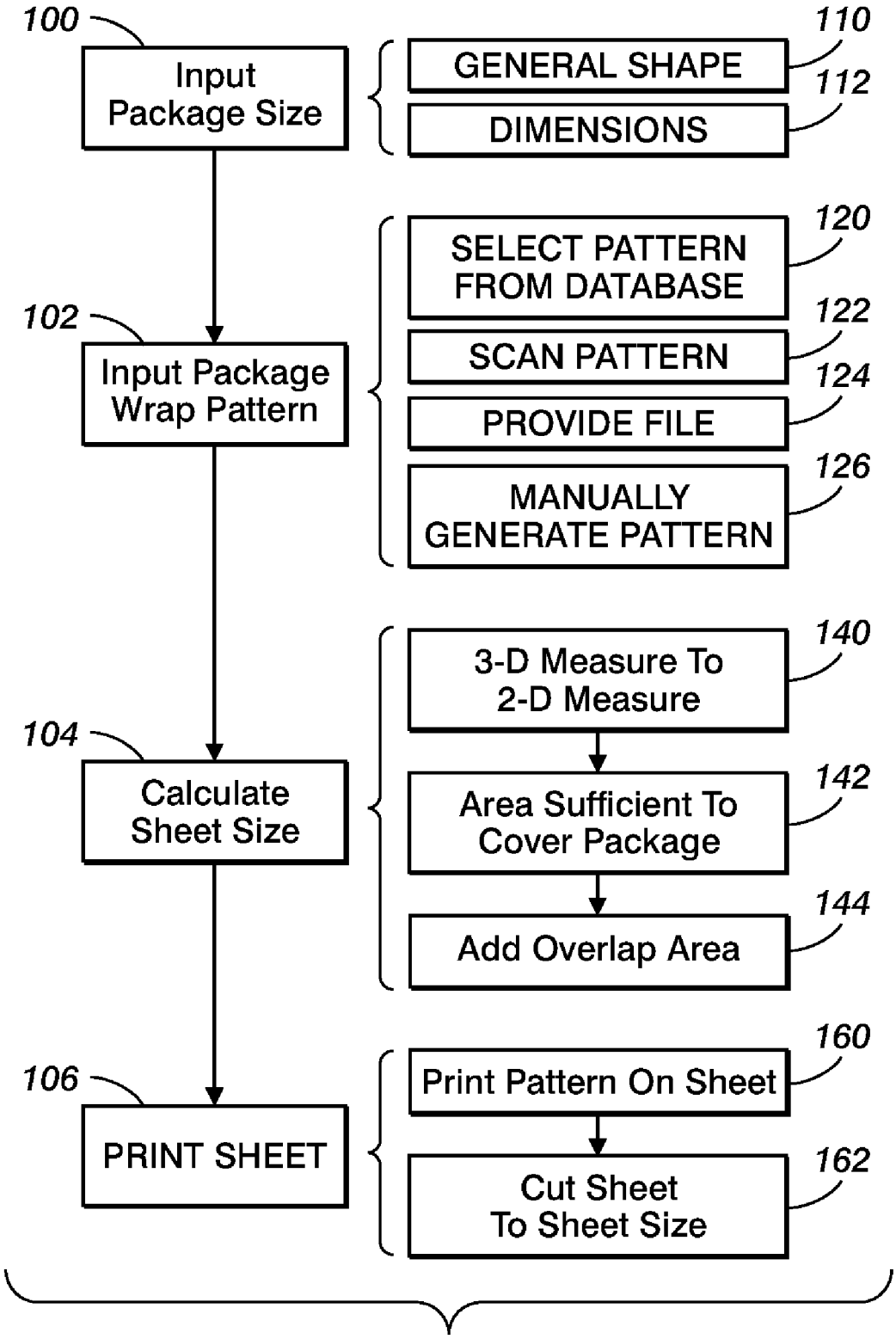
FIG. 1 is a flow diagram illustrating an embodiment herein.

The embodiments herein provide processes, systems, services, computer programs, etc. to print package wrap (e.g., gift wrap) and more particularly to a system, service, and method that prints custom sheets of package wrap that matches a selected package size precisely.

As illustrated in flowchart form in FIG. 1, embodiments herein include a method that inputs a package size (item 100) and inputs a package wrap pattern (item 102). In item 104, the method automatically calculates a sheet size corresponding to the package size and, in item 106, automatically prints the sheet of package wrap to contain the selected pattern and have the calculated sheet size.

When inputting the package size in item 100, a user can be requested to input the general shape of the package in item 110. The general shape can be any useful description the user of the embodiments herein might favor. For example, the user can be given the option to choose from rectangular shapes, rounded shapes, or irregular shapes.

Once the user has chosen a general shape, they are provided different questions, depending upon which shape is selected, to allow approximate dimensions of the package to be input in item 112. For example, if the user chooses rectangular shapes, they can be provided with input fields for the height, width, and depth of the package. If the user indicates that the package has a rounded shape, they can be requested to provide the circumference, diameter, and thickness of the item. For irregularly shaped packages, the user can be requested enter the highest height dimension of the package, the widest width dimension of the package and the deepest depth of the package.

Note that these embodiments are not limited to the specific user interface options described herein, and instead the specific user interfaces are used herein merely as examples to illustrate one way in which the embodiments herein can operate. One ordinarily skilled in the art would understand that the user interface described herein can be modified substantially depending upon the specific application to which the embodiments herein find use.

Further, when the user is inputting the package wrap pattern in item 102, in one illustrative example, they can be provided the options of selecting the package wrap pattern from a database (item 120), scanning an image or item to store the package wrap pattern into memory (item 122), providing a file having the package wrap pattern (item 124), and/or manually generating the package wrap pattern using a graphic user interface (item 126).

The "calculating" performed by item 104 can comprise many different types of operations, again depending upon the specific environment and uses to which the embodiments herein will be subjected. For example, when performing the calculation of the sheet size, the embodiments herein can convert a three-dimensional measure of the package size into a two-dimensional measure of the sheet size as shown by item 140. More specifically, in item 140, while there are many methods for converting a three-dimensional measure into two-dimensional space, one operation that could be utilized with the embodiments herein combines the contiguous geometric shapes and sizes from the three-dimensional space to result in the length and width measure of the two-dimensional space. Further, such calculations can add to the sheet size to accommodate the folding regions that will be required when the printed sheet is attached to the package.

Further, the "calculating" of the sheet size can comprise (in item 142) determining a first area sufficient to cover all surface area of a package having the package size, potentially based on the three-dimensional to two-dimensional conversion performed in item 140. In addition, this process would add an overlap area to the first area (item 124) to produce the sheet size. Such an overlap area allows the user some inaccuracy when actually attaching the printed package wrap sheet to the package.

The actual printing of the sheet in item 106 comprises two basic elements. First, the pattern is printed on the sheet in item 160. Secondly, the sheet is automatically cut to size in item 162. The printing 160 can include the customize pattern, customized text, and fold markings. Thus, once printed, the sheet of package wrap has the package wrap pattern and can have fold markings corresponding to corners of the package size. The sheet of package wrap is cut to have dimensions equal to the sheet size.

Fold markings can be added at the edges of each of the surfaces, such as at the corners of a rectangular structure, or to areas where folds are necessary to account for the size of excess material that could not be eliminated from a sheet that is cut to size. Some embodiments herein will only produce rectangular cut sheets. Such rectangular cut sheets may include excess sheet material that needs to be folded beneath or over other sheet material in order to accommodate the package size and the fold markings can indicate to the user where such folds should be made in the sheet. The fold markings can comprise light markings printed on the same side of the sheet as the custom pattern. Such fold markings should be light enough to be substantially unnoticed by those other than the individual making the folds. Alternatively, the fold markings can comprise changes in direction of the custom wrap pattern. Further, the fold markings can be printed on the opposite side of the sheet from the custom wrap pattern, if two-sided (duplex) printing is available. While various types of fold markings have been discussed herein, one ordinarily skilled in the art would understand that many different types of fold markings can be used with embodiments herein.

Another embodiment, shown in FIG. 2, comprises a system 200 that includes a central processing unit 204 (within a device, such as a printer or computer 202) and graphic user interface 250. The system 200 also includes a scanner 270 operatively connected to the graphic user interface 250 through the computer 202 and central processing unit 202. A memory 206 is provided in the system 200 operatively connected to the scanner 270 and the processor 204.

The graphic user interface 250 is adapted to receive input of the package size and the package wrap pattern (as discussed above). The processor 204 is operatively (directly or indirectly) connected to the graphic user interface 250. The processor 204 is adapted to calculate a sheet size corresponding to the package size and optionally calculate fold markings corresponding to corners of the package, as discussed in detail above. The processor 204 is adapted to calculate the sheet size by determining a first area sufficient to cover all surface area of a package having the package size and adding an overlap area to the first area to produce the sheet size, as discussed above. A printer 260 is also operatively connected to the processor 204 (or the processor 204 could be included within the printer 260).

The graphic user interface 250 comprises inputs for dimensions of the package (height, width, depth, radius, circumference, thickness, etc. as discussed above) to input the package size. Further, the graphic user interface 250 includes inputs for selecting the package wrap pattern from a database (either in the electronic memory 206 or available through a network connected to the input/output 250), scanning the package wrap pattern into memory 206 (using the scanner 270), providing a file through the input/output 250 having the package wrap pattern, and/or generating the package wrap pattern using various pointing devices available in the graphic user interface 250.

As shown in greater detail in FIG. 3, the printer 260 comprises a printing engine 302 adapted to print the sheet of package wrap 304 having the package wrap pattern and, optionally, the fold markings. A sheet cutter 306 can be included within or separate from the printer. The sheet cutter 306 is adapted to cut the sheet of media into dimensions equal to the sheet size.

A continuous media supply 308 (e.g., roll of printing media such as paper) is positioned to supply a continuous, unbroken sheet of media 310 to the printer 260. The printer 260 can also include the GUI I/O 250 and CPU 204, discussed above. Thus, once printed and cut, the sheet of package wrap 312 has the package wrap pattern and can have fold markings corresponding to corners of the package size. The sheet of package wrap 312 has dimensions equal to the sheet size.

The sheet cutter 306 can comprise a sheet cutter that can form complex shapes, such as curves, diagonals, steps, etc. or can comprise a simplified cutter that merely cuts a certain length of sheet as it exits the printing engine 302. With more sophisticated cutters, the exact pattern needed to wrap the package precisely can be output. To the contrary, with more simplified length-based sheet cutters, only rectangles of wrapping paper are produced. Many sheet cutters are readily available from manufactures such as Baumfolder Corporation, Sidney, Ohio, USA and Wenzhou Dai's Printing Machine Co., Ltd, Wenzhou City, Zhejiang Province, China and the details of such devices are well-known and not discussed herein.

Thus, embodiments herein can use complex cutting machines or simply include output instructions passed to the printer operator (for example, through the graphic user interface 250) instructing the operator to connect to any specific width sheet supply roll 308 (e.g., 11 inch, 17 inch, 24 inch, 36 inch, etc.) to the printer 260 so that both of the length and the width of the cut wrapping paper sheet that is output from the sheet cutter can be easily controlled.

Various computerized devices are mentioned above. Computers that include input/output devices, memories, processors, etc. are readily available devices produced by manufactures such as International Business Machines Corporation, Armonk N.Y., USA and Apple Computer Co., Cupertino Calif., USA. Such computers commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Stamford, Conn., USA and Visioneer, Inc. Pleasanton, Calif., USA and the details of such devices are not discussed herein for purposes of brevity and reader focus.

The embodiments herein can be used with any conventional device that has the ability to print large enough sheets of paper to accommodate the packages that will be wrapped. Exemplary hardware systems that efficiently print wide sheets are disclosed in U.S. Patent Publications 2005/0157141 and 2006/0227203 (the complete disclosures of which are incorporated herein by reference).

The word "printer" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. Printers are readily available devices produced by manufactures such as Xerox Corporation, Stamford, Conn., USA. Such printers commonly include input/output, power supplies, processors, media movement devices, marking devices etc., the details of which are omitted herefrom to allow the reader to focus on the salient aspects of the embodiments described herein.

All foregoing embodiments are specifically applicable to electrostatographic and/or xerographic machines and/or processes as well as to software programs stored on the electronic memory (computer usable data carrier) 206 and to services whereby the foregoing methods are provided to others for a service fee. It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof.

What is claimed is:

1. A system comprising:

a graphic user interface to receive input of a package size and a package wrap pattern;

a processor operatively connected to said graphic user interface, wherein said processor to automatically calculates a sheet size corresponding to said package size;

a printer operatively connected to said processor, wherein said printer comprises a printing engine to automatically print said package wrap pattern on a sheet of package wrap; and a sheet cutter to automatically cut said sheet of media into dimensions equal to said sheet size, and wherein said graphic user interface comprises inputs for at least one of a height, a width, a depth, a circumference, a radius, a diameter, and a thickness of a package to input said package size.

2. The system according to claim 1, further comprising a continuous media supply positioned to supply a continuous sheet of media to said printer.

3. The system according to claim 1, wherein processor to calculates said sheet size by determining a first area sufficient to cover all surface area of a package having said package size and adding an overlap area to said first area to produce said sheet size.

4. The system according to claim 1, wherein said graphic user interface comprises at least one of:

an input to select said package wrap pattern from a database;

an input to scan said package wrap pattern into memory;

an input to provide a file having said package wrap pattern; and an input to manually generate said package wrap pattern.

5. A system comprising:

a graphic user interface to receive input of a package size and a package wrap pattern;

a processor operatively connected to said graphic user interface, wherein said processor automatically calculates a sheet size corresponding to said package size and automatically calculates fold markings corresponding to corners of said package size;

a printer operatively connected to said processor, wherein said printer comprises a printing engine to automatically print said package wrap pattern and said fold markings on a sheet of package wrap; and a sheet cutter to automatically cut said sheet of media into dimensions equal to said sheet size, and wherein said graphic user interface comprises inputs for at least one of a height, a width, a depth, a circumference, a radius, a diameter, and a thickness of a package to input said package size.

6. The system according to claim 5, further comprising a continuous media supply positioned to supply a continuous sheet of media to said printer.

7. The system according to claim 6, wherein the processor to calculates said sheet size by determining a first area sufficient to cover all surface area of a package having said package size and adding an overlap area to said first area to produce said sheet size.

8. A computer storage medium comprising:

a computer-usable data carrier storing instructions that, when executed by a computer, cause the computer to perform a method comprising:

inputting a package size;

inputting a package wrap pattern;

automatically calculating a sheet size corresponding to said package size;

automatically printing said package wrap pattern on a sheet of package wrap; and automatically cutting said sheet of package wrap into dimensions equal to said sheet size, wherein said inputting of said package size comprises requesting a user to input at least one of a height, a width, a depth, a circumference, a radius, a diameter, and a thickness of a package.

9. The computer storage medium according to claim 8, wherein said calculating comprises converting a three-dimensional measure of said package size into a two-dimensional measure of said sheet size.

10. The computer storage medium according to claim 8, wherein said calculating of said sheet size comprises determining a first area sufficient to cover all surface area of a package having said package size and adding an overlap area to said first area to produce said sheet size.

11. The computer storage medium according to claim 8, wherein said inputting of said package wrap pattern comprises at least one of:

selecting said package wrap pattern from a database;

scanning said package wrap pattern into memory;

providing a file having said package wrap pattern; and generating said package wrap pattern using a graphic user interface.

* * * * *